US006328230B1

(12) United States Patent
Prillwitz et al.

(10) Patent No.: US 6,328,230 B1
(45) Date of Patent: Dec. 11, 2001

(54) FUEL INJECTOR FOR AN INTERNAL COMBUSTION ENGINE

(75) Inventors: Rolf Prillwitz, Möglingen; Hans-Joachim Koch, Glatten, both of (DE)

(73) Assignee: L'Orange GmbH, Stuttgart (DE)

( * ) Notice: Subject to any disclaimer, the term of this patent is extended or adjusted under 35 U.S.C. 154(b) by 0 days.

(21) Appl. No.: 09/581,642

(22) PCT Filed: Mar. 2, 1999

(86) PCT No.: PCT/DE99/00544

§ 371 Date: Jun. 15, 2000

§ 102(e) Date: Jun. 15, 2000

(87) PCT Pub. No.: WO99/45266

PCT Pub. Date: Sep. 10, 1999

(30) Foreign Application Priority Data

Mar. 3, 1998 (DE) ..... 198 08 798

(51) Int. Cl.[7] ..... B05B 7/12; F02B 3/00

(52) U.S. Cl. ..... 239/407; 239/408; 239/413; 239/416.2; 239/417.5; 239/585.1; 239/584; 123/27 GE; 123/299; 123/300

(58) Field of Search ..... 239/407, 408, 239/413, 416.2, 417.5, 583, 584, 585.1; 123/27 GE, 299, 300, 526

(56) References Cited

U.S. PATENT DOCUMENTS

| | | | | |
|---|---|---|---|---|
| 4,033,301 | * | 7/1977 | Walton | 123/32 G |
| 4,499,862 | * | 2/1985 | Bäumer et al. | 123/299 X |
| 5,862,793 | * | 1/1999 | Jay et al. | 123/299 X |
| 6,073,862 | * | 6/2000 | Touchette et al. | 239/408 |

FOREIGN PATENT DOCUMENTS

| | | |
|---|---|---|
| 0 575 887 A1 | 6/1993 | (EP) . |
| 0 778 410 A1 | 6/1997 | (EP) . |

* cited by examiner

*Primary Examiner*—David A. Scherbel
*Assistant Examiner*—Robin O. Evans
(74) *Attorney, Agent, or Firm*—Crowell & Moring, LLP

(57) ABSTRACT

A fuel injector for an internal combustion engine includes a first injection valve having a first valve element that can be displaced in an axial direction and a first actuating device located axially downstream from the first injection valve to actuate the first injection valve. The fuel injector also has at least one second injection valve with a valve element that can be axially displaced and a second actuating device to actuate the second injection valve. The second actuating device is mounted axially downstream from the first actuating device in the valve housing, and the second actuating device to actuate the second injection valve is coupled to the latter by an actuating element, in the form of a cage-like arrangement, mounted in the valve housing in such a way that it can be displaced axially and bypasses the first actuating device.

22 Claims, 2 Drawing Sheets

FUEL INJECTOR FOR AN INTERNAL COMBUSTION ENGINE

BACKGROUND AND SUMMARY OF THE INVENTION

The present invention relates to a fuel injector for an internal-combustion engine.

For operation of fuel injection systems in which fuel is stored under high pressure in a preliminary storage tank and, in response to a control signal supplied from the outside, is injected by fuel injectors during a defined injection interval into the combustion space of an internal-combustion engine (common-rail systems), fuel injectors have become known for selective or simultaneous actuation using various fuels; such fuels may, for example, be a liquid fuel, such as Diesel oil, and a gaseous fuel, such as a combustible gas.

A fuel injector of this type contains a first injection valve, which is arranged in a valve housing and contains a first valve member which can be axially displaced between a closed position and an open position, for injecting a first fuel into the combustion space of the internal-combustion engine, as well as a first actuating device, which is coupled directly or by way of a first actuating element with the first valve member and is provided in the valve housing axially behind the first injection valve, for opening and closing the first injection valve. Furthermore, the fuel injector contains at least one second injection valve, which is arranged in the valve housing and contains a second valve member which can be axially displaced between a closed position and an open position, for injection of at least one second fuel into the combustion space of the internal-combustion engine, as well as at least one second actuating device, which is coupled with the second valve member, for opening and closing the second injection valve.

A fuel injector of this type is known, for example, from European Patent Document EP 0 575 887 A1. In this known fuel injector, the valve member of the first injection valve is controlled directly by being acted upon by a hydraulic closing pressure. The valve member of the second injection valve is controlled by way of a double-piston arrangement which is also acted upon by the hydraulic closing pressure.

One difficulty in the construction of fuel injectors for several fuels is that, on the one hand, the arrangement of several actuating devices for the various fuels in the fuel injector requires a relatively large amount of space, and, on the other hand, the space which is available for the fuel injectors on an internal-combustion engine, such as a Diesel engine, is limited.

It is therefore an object of the invention to provide a fuel injector, for an internal-combustion engine which has several injection valves for operation with several fuels, in which the actuating devices for the various injection valves are arranged in a space-saving manner.

The fuel injector according to the invention contains a first injection valve, which is arranged in a valve housing and contains a first valve member which can be axially displaced between a closed position and an open position, for injecting a first fuel into the combustion space of the internal-combustion engine, as well as a first actuating device, which is coupled directly or by way of a first actuating element with the first valve member and is provided in the valve housing axially behind the first injection valve, for opening and closing the first injection valve. At least one second injection valve is arranged in the valve housing and contains a second valve member which can be axially displaced between a closed position and an open position. The at least one second injection value is used for injecting at least one second fuel into the combustion space of the internal-combustion engine. At least one second actuating device is coupled with the second valve member for opening and closing the second injection valve. According to the invention, the valve member of the second injection valve is arranged radially at a distance from the valve member of the first injection valve in the valve housing, the second actuating device is arranged axially downstream of the first actuating device in the valve housing, and the valve member of the second injection valve is coupled with the second actuating device by way of a second actuating element which is axially displaceably disposed in the valve housing and surrounds the first actuating device.

The significant advantage of the fuel injector according to the invention is that its valve housing can be manufactured with a very small diameter. This permits the use of the fuel injector when the space available on the internal-combustion engine is very limited and allows operation by way of several fuels. Another advantage is the possibility of a centric arrangement of the injection valve, which simplifies the manufacturing of the fuel injector.

Advantageously, at least two second injection valves which have valve members radially spaced from the valve member of the first injection valve are arranged in the valve housing.

In such an embodiment, it is advantageous to arrange the valve members of the second injection valves essentially diametrically with respect to the valve member of the first injection valve.

According to a particularly advantageous embodiment of the fuel injector according to the invention, the second actuating element contains several tappet-type actuating members which are disposed in an axially displaceable manner radially outside the first actuating device in the valve housing. This permits a slim construction and therefore a low space requirement.

Advantageously, the second actuating element contains a yoke, arranged at the end side, for coupling the tappet-type actuating members with the second actuating device.

This construction may advantageously be further developed by providing the yoke with a plate shape and, for joint actuation of the tappet-type actuating members, by centrically coupling the yoke with the second actuating device.

The yoke advantageously has radially extending arms for actuating the tappet-type actuating members. The number of arms corresponds to the number of the tappet-type actuating members, each of which is arranged coaxially with respect to the others.

The number of the tappet-type actuating members advantageously corresponds to the number of the second injection valves.

In this case, it is particularly advantageous for each of the tappet-type actuating members to be arranged coaxially with respect to the valve members of the second injection valves.

Advantageously, the tappet-type actuating members are arranged on the same radius with respect to the injector axis.

According to a further development of the fuel injector according to the invention, the second actuating element contains a ring element arranged, at the end side, for the coupling of the valve members of the second injection valves with the tappet-type actuating members. In this case, the ring element surrounds the first actuating device or the valve member and/or the first actuating element of the first injection valve.

The above-mentioned embodiment may be further developed by providing the ring element with radially inwardly projecting arms for actuating the valve members of the second injection valves.

According to another advantageous embodiment of the fuel injector according to the invention, the valve housing is constructed in several parts, and the second actuating element, together with the first actuating device, is housed in a separate housing part in which the tappet-type actuating members are axially displaceably disposed. This represents a significant simplification with respect to the production, the assembly and the maintenance of the fuel injector.

According to a further advantageous embodiment of the fuel injector according to the invention, the tappet-type actuating members, together with the yoke arranged on the end side and/or the ring element arranged on the end side, form an actuating arrangement which surrounds the first actuating device in a cage-type manner.

In this case, the cage arrangement formed by the tappet-type actuating members and the yoke arranged on the end side and/or the ring element arranged on the end side are advantageously accommodated in the second housing part. The yoke arranged on the end side is disposed at one side and/or the ring element arranged on the end side is arranged at the other end of the separate housing part.

In the valve housing, the fuel injector advantageously has one or several fuel ducts which extend, at least in sections, inside this actuating cage.

In this case, the fuel ducts can be spaced radially and/or in the circumferential direction away from the tappet-type actuating members of the actuating cage.

According to an alternative embodiment of the fuel injector according to the invention, an actuating device, coupled with the valve member of the second injection valve, is provided for each individual second injection valve or in each case for several of the second injection valves. This permits actuating each individual second injection valve or groups of several of the second injection valves independently of one another.

This embodiment may be further developed by coupling the actuating devices in each case by way of a tappet-type actuating element with the valve member of the assigned second injection valve.

In the fuel injector according to the invention, the first actuating device may be constructed as an electromagnetic actuating device.

The second actuating device of the fuel injector according to the invention may be constructed as a mechanical or hydromechanical actuating device.

According to an advantageous embodiment, the fuel injector according to the invention is constructed for optional operation with diesel oil and/or a gaseous fuel. The first injection valve is provided for feeding diesel oil and the second injection valves are provided for feeding the gaseous fuel.

An embodiment of the fuel injector according to the invention will be explained in the following by way of reference to the drawing figures.

DESCRIPTION OF THE PREFERRED EMBODIMENTS

Figure 1:
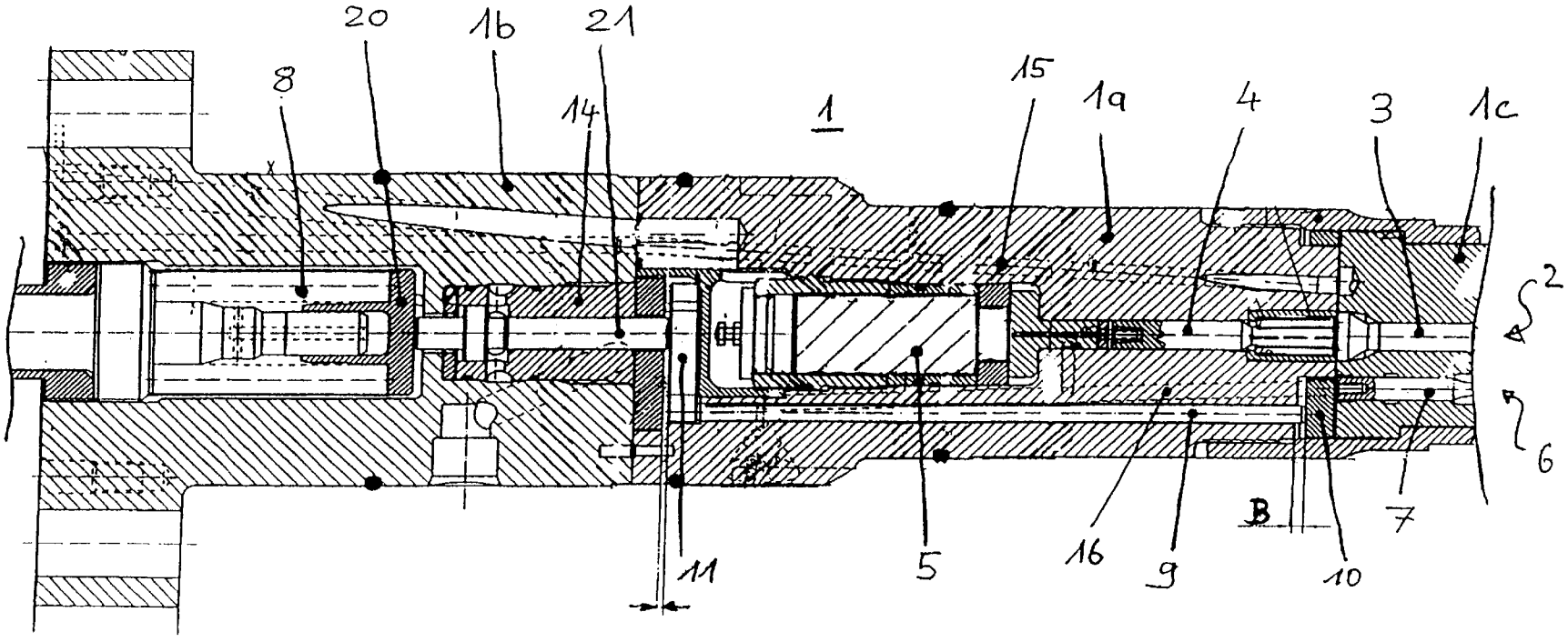
FIG. 1 is a partial cross-sectional view of a fuel injector according to an embodiment of the invention.

FIG. 1 is a partial cross-sectional view of a fuel injector according to a first embodiment of the invention. A valve member 3 of a first injection valve 2 is arranged in a valve housing 1; the valve member can be displaced in the axial direction between an open position and a closed position. The first injection valve 2 is used for injecting a first fuel into the combustion space of an internal-combustion engine, for example, for injecting diesel oil into the combustion space of a diesel engine. By way of a first actuating element 4, which is constructed in the form of a tappet, the first valve member 3 is coupled with a first actuating device 5 which may, for example, be an electromagnetic actuating device, which is well known in the field of fuel injectors. Several valve members 7 of second injection valves 6 are arranged at a radial distance surrounding the valve member 3 of the first injection valve 2. In the illustrated embodiment, three second injection valves 6 of this type are provided; the three second injection valves have three actuating members 7, of which one is visible in the sectional view of FIG. 1. The second injection valves 6 are used for injecting a second fuel into the combustion space of the internal-combustion engine, in the case of the described embodiment, in the form of a gas.

For actuating the second injection valves 6, a second actuating device 8 is provided in the housing 1 of the fuel injector and is arranged axially behind the first actuating device 5. The second actuating device 8 may be a mechanical or hydromechanical actuating device, as is well known in the field of fuel injectors.

By way of a second actuating element 9, 10, 11, which is axially displaceably disposed in the valve housing 1 and bypasses the first actuating device 5, the actuating members 7 of the second injection valves 6 are coupled with the second actuating device 8 for the purpose of opening and closing the second injection valves 6.

The second actuating element 9, 10, 11 has several tappet-type actuating members 9*a, b, c*, which are axially displaceably disposed in the valve housing 1 and a yoke 11, which is arranged on the actuating device side, for coupling the tappet-type actuating members 9*a, b, c* with the second actuating device 8 by way of a tappet 21 and a pressure element 20, which are also axially displaceably arranged in the valve housing 1. The second actuating element also has a ring element 10 arranged on the injection valve side for coupling the valve members 7 of the second injection valves 6 with the tappet-type actuating members 9*a, b, c*. The tappet-type actuating members 9*a, b, c* are arranged surrounding the first actuating device 5 radially around the axis of the fuel injector.

The yoke 11 arranged on the actuating device side has a plate-shaped construction, the tappet 21 coupling the yoke 11 with the second actuating device 8 acting centrically upon the plate-shaped yoke 11. The ring element 10 arranged on the injection valve side surrounds the first actuating element 4 which couples the first actuating device 5 with the valve member 3 of the first injection valve 2.

FIG. 2*a* is a perspective view of the second actuating element formed of the tappet-type actuating member 9*a, b, c*, the yoke 11 and the ring element 10. As illustrated, the yoke 11 has three radially extending arms 13*a, b, c*, which are coupled with the actuating-device-side ends of the tappet-type actuating members 9*a, b, c*. The injection-valve-side ends of the tappet-type actuating members 9*a, b, c* are coupled with radially inward-extending arms 12*a, b, c*, which are constructed on the ring element 10.

The number of the radially extending arms 13*a, b, c* of the yoke 11, of the tappet-type actuating members 9*a, b, c*, and of the radially inward-extending arms 12*a, b, c* of the ring element 10 correspond to the number of the second injection valves 6 and their valve members 7. In the illustrated embodiment, this number is three. The radially inward-extending arms 12*a, b, c* of the ring element 10 are provided for actuating the valve members 7 of the second injection valves 6. The tappet-type actuating members 9*a, b, c* are arranged in the same radial plane as the valve members 7 of the second injection valves 6, but are offset radially to the outside with respect to the latter, as illustrated in FIG. 1. The radial distance between the valve members 7 and the tappet-type actuating members 9*a, b, c* is bridged by the radial course of the inward-extending arms 12*a, b, c* of the ring element 10.

Figure 2:
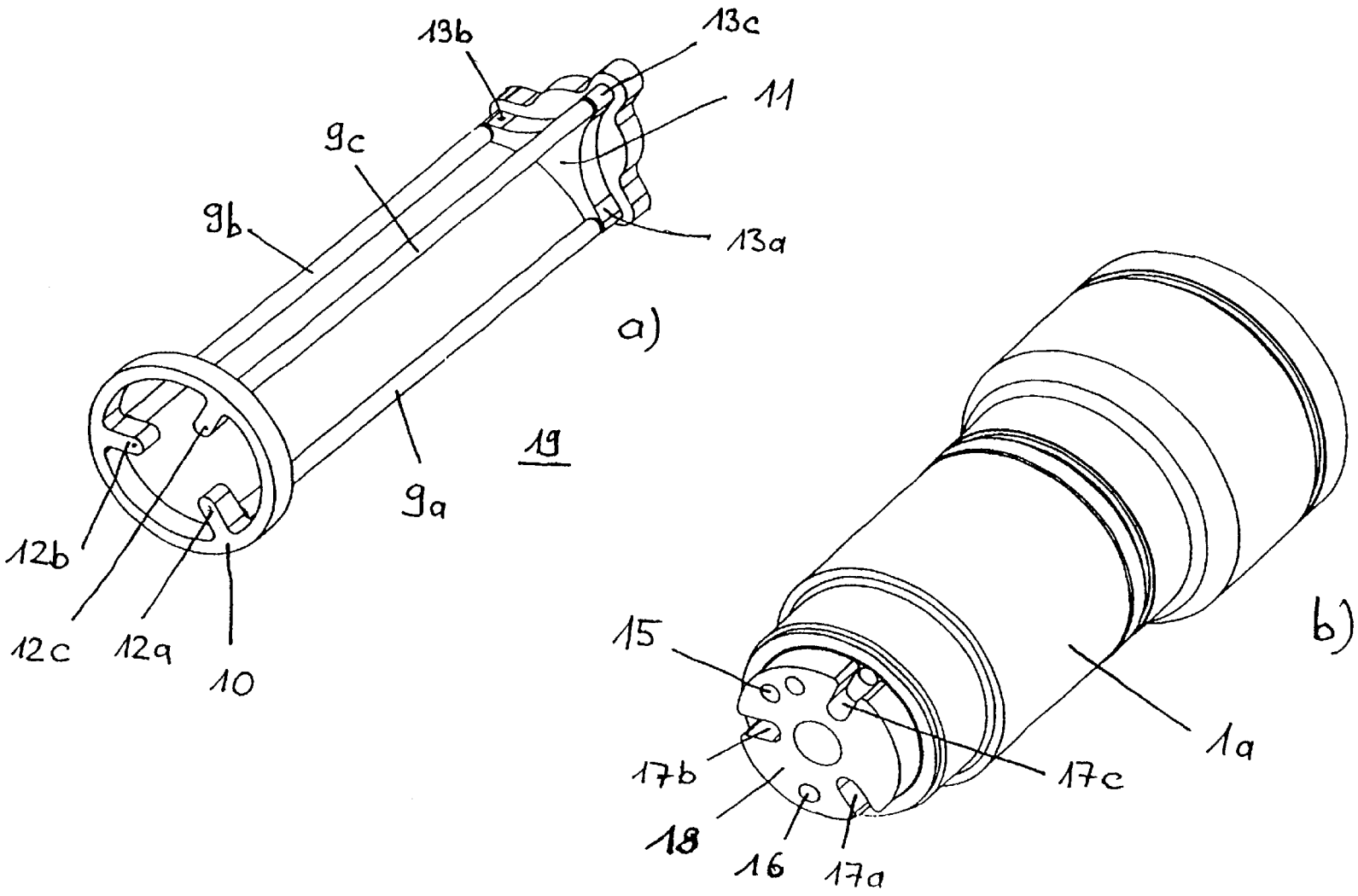
FIGS. 2*a* and 2*b* are perspective views of a second actuating element constructed in the form of an actuating cage for actuating the second fuel injection valves and of a housing part of the fuel injector according to the invention in which the second actuating element constructed as an actuating cage and the actuating device for the first injection valve are accommodated.

The tappet-type actuating members 9*a, b, c*, the yoke 11 and the ring element 10, together, form a cage-type actuating arrangement which, in FIG. 2, as a whole, has the reference number 19.

As illustrated in FIG. 1, the housing 1 of the fuel injector has several parts. A first housing part 1*a* contains the first actuating device 5 and the actuating cage 19 surrounding the latter, while a second housing part 1*b* contains the second actuating device 8 and the pressure element 20 and the tappet 21, which couple the second actuating device 8 with the yoke 11. A third housing part 1*c* contains the valve members 3, 7 of the first injection valve 2 and of the second injection valves 6.

As illustrated in FIG. 2*b*, which is a perspective view of the first housing part 1*a* of the fuel injector, this first housing part has recesses 17*a, b, c*, on a sealing surface 18, in which recesses the radially inward-extending arms 12*a, b, c* of the ring element 10 are received. The ring-shaped exterior part of the ring element 10 surrounds this sealing surface 18.

The yoke 11 is situated at one end of the housing part 1*a*; the ring element 10 is situated at the other end of the housing part 1*a*.

The first injection valve 2 and the second injections valves 6 are supplied with fuel by way of fuel ducts 15, 16. These fuel ducts extend in the longitudinal direction through the valve housing 1, that is, through the first housing part 1*a* as well as through the second housing part 1*b*. In the first housing part 1*a*, the fuel ducts 15, 16 extend at least in sections inside the cage-type actuating arrangement 19, in which case the fuel ducts 15, 16 are spaced radially and/or in the circumferential direction away from the tappet-type actuating members 9*a, b, c* of the actuating cage 19.

As an alternative to the illustrated embodiment, instead of a single second actuating device 8 for actuating the second injection valves 6, several separate actuating devices can be provided. Each such actuating device is coupled with an individual second injection valve or with several second injection valves 6 arranged in groups and their valve members 7. As a result, a separate actuation of each individual second injection valve or of the groups of second injection valves 6 can be carried out. In the case of second actuating devices which are each assigned to each individual second injection valve 6, one valve member 7, respectively, of the assigned second injection valve 6 would then be coupled by way of one tappet-type actuating element 9 with the assigned actuating device.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Fuel injector for an internal-combustion engine, comprising:

a first injection valve which is arranged in a valve housing and contains a first valve member which can be axially displaced between a closed position and an open position, said first infection valve injecting a first fuel into a combustion space of the internal-combustion engine, a first actuating device which is coupled directly or by way of a first actuating element with the first valve member and provided in the valve housing axially behind the first injection valve, said first activating device opening and closing the first injection valve, at least one second injection valve, which is arranged in the valve housing and contains a second valve member which can be axially displaced between a closed position and an open position, for said at least one second injection valve injecting at least one second fuel into the combustion space of the internal-combustion engine, and at least one second actuating device which is coupled with the second valve member so as to open and close the second injection valve, wherein the second valve member of the at least one second injection valve is arranged in a radially spaced manner with respect to the first valve member of the first injection valve in the valve housing, wherein the at least one second actuating device is provided in the valve housing and is arranged axially behind the first actuating device, and wherein the second valve member of the at least one second injection valve is coupled with the at least one second actuating device by way of a second actuating element, which is axially displaceably disposed in the valve housing and bypasses the first actuating device.

2. Fuel injector according to claim 1, wherein at least two of said second injection valves are provided in the valve housing, said second injection valves having second valve members which are radially spaced with respect to the first valve member of the first injection valve.

3. Fuel injector according to claim 2, wherein said second valve members of the second injection valves are arranged essentially diametrically with respect to the first valve member of the first injection valve.

4. Fuel injector according to claim 1, wherein the second actuating element contains several tappet-type actuating members which are axially displaceably arranged radially outside the first actuating device in the valve housing.

5. Fuel injector according to claim 4, wherein the second actuating element contains a yoke arranged at an end side in order to couple the tappet type actuating members with the at least one second actuating device.

6. Fuel injector according to claim 5, wherein the yoke has a plate-shaped construction and, for joint actuation of the tappet-type actuating members, is centrically coupled with the at least one second actuating device.

7. Fuel injector according to claim 5, wherein the yoke, in order to actuate the tappet-type actuating members, has radially extending arms, the number of arms corresponding to the number of the tappet-type actuating members and these being arranged coaxially with respect to one another.

8. Fuel injector according to claim 4, wherein the number of said tappet-type actuating members corresponds to that of the at least one second injection valve.

9. Fuel injector according to claim 8, wherein each of the tappet-type actuating members is arranged coaxially with respect to the second valve member of the at least one second injection valve.

10. Fuel injector according to claim 4, wherein the tappet-type actuating members are arranged on the same radius with respect to an injector axis.

11. Fuel injector according to claim 5, wherein the second actuating element contains a ring element arranged at an end side in order to couple the second valve member of the at least one second injection valve with the tappet-type actuating members, the ring element surrounding at least one of the first actuating device, the first valve member and the first actuating element of the first injection valve.

12. Fuel injector according to claim 11, wherein the ring element has radially inward-projecting arms in order to actuate the second valve member of the at least one second injection valve.

13. Fuel injector according to claim 4, wherein the valve housing is constructed of several parts, the second actuating element, together with the first actuating device, being accommodated in a separate housing part, in which the tappet-type actuating members are axially displaceably disposed.

14. Fuel injector according to claim 11, wherein the tappet-type actuating members, together with at least one of the yoke and the ring element, form an actuating cage arrangement which surrounds the first actuating device in a cage-type manner.

15. Fuel injector according to claim 14, wherein the cage arrangement and at least one of the yoke and the ring element is accommodated in a separate housing part and the yoke is arranged so that the end side is situated on one end and/or the ring element arranged at the end side is situated on the other end of the separate housing part.

16. Fuel injector according to claim 14, wherein the valve housing has at least one fuel duct which extends at least in sections inside the actuating cage arrangement.

17. Fuel injector according to claim 16, wherein the at least one fuel duct includes several fuel ducts are spaced radially and/or in the circumferential direction away from the tappet-type actuating members of the actuating cage arrangement.

18. Fuel injector according to claim 1, wherein said at least one second actuating device, which is coupled with the second valve member of the at least one second injection valve, is provided for each individual second injection valve or in each case for several second injection valves.

19. Fuel injector according to claim 18, wherein each said at least one actuating device is coupled by way of a tappet-type actuating element with the second valve member of the at least one second injection valve.

20. Fuel injector according to claim 1, wherein the first actuating device an electromagnetic actuating device.

21. Fuel injector according to claim 1, wherein the at least one second actuating device is a mechanical or hydromechanical actuating device.

22. Fuel injector according to claim 1, wherein the fuel injector is constructed for optional operation with at least one of diesel oil and a gaseous fuel, the first injection valve being provided for feeding of diesel oil and the at least one second valve being provided for feeding of the gaseous fuel.

* * * * *